United States Patent [19]

Kawachi

[11] 4,078,467

[45] Mar. 14, 1978

[54] VOLUME CONTROLLER FOR ELECTRIC MUSICAL INSTRUMENT OF PORTABLE TYPE

[76] Inventor: Kiyoshi Kawachi, 2-5-18, Hibarigaokakita, Hoya, Tokyo, Japan

[21] Appl. No.: 698,673

[22] Filed: Jun. 22, 1976

[30] Foreign Application Priority Data

Jun. 23, 1975 Japan ..... 50-84925[U]
Dec. 5, 1975 Japan ..... 50-145313

[51] Int. Cl.[2] ..... G10H 1/02
[52] U.S. Cl. ..... 84/1.27; 84/1.09; 84/1.24
[58] Field of Search ..... 84/1.01, 1.09, 1.12, 84/1.16, 1.24, 1.25, DIG. 19; 338/68, 69, 98, 184, 199; 340/282; 324/34 PS; 200/61.45 R, 61.52, 153 A

[56] References Cited

U.S. PATENT DOCUMENTS

| | | | |
|---|---|---|---|
| 2,179,237 | 11/1939 | Stibitz | 84/1.12 |
| 3,042,888 | 7/1962 | Park | 338/69 X |
| 3,965,790 | 6/1976 | Suzuki et al. | 84/DIG. 19 X |

*Primary Examiner*—Ulysses Weldon
*Attorney, Agent, or Firm*—Robert E. Burns; Emmanuel J. Lobato; Bruce L. Adams

[57] ABSTRACT

A volume controller for an electric musical instrument of portable type, in which an audio-signal transmission circuit is provided in the signal path of the electric musical instrument. The audio-signal transmission circuit includes a variable circuit element. A pendulum is provided in a casing of the electric musical instrument so as to be swung about a supporting shaft. The value of the variable circuit element is controlled in accordance with the swing of the pendulum to vary the sound volume of the electric musical instrument. A level may be provided on the casing to indicate the controlled condition of the pendulum. A stopper may be provided to temporarily stop the swing of the pendulum.

17 Claims, 10 Drawing Figures

VOLUME CONTROLLER FOR ELECTRIC MUSICAL INSTRUMENT OF PORTABLE TYPE

FIELD OF THE INVENTION

This invention relates to a volume controller for electric or electronic musical instruments of portable type, such as electric accordions, and electric guitars, which are played in such manner as held by player's hands or arms.

BRIEF DESCRIPTION OF THE PRIOR ART

In playing such musical instrument as an electronic organ set on the floor, the player can control the sound volume controller by the player's foot or knees. However, in playing an electric or electronic musical instrument of portable type, for example an electric accordion, the player has to operate keys and chord-buttons while supporting the instrument in the player's arms. Accordingly, the player's hands are too busy to freely control the sound volume during the player plays the instrument in order to get satisfactory effect of the performance.

In such musical instrument as an electric guitar, since the sound is originally generated by a vibration of a string and then converted into an electric signal, the sound volume can be controlled by varying the intensity of string vibration. However, the appropriate volume control requires a great deal of skill, while the volume control range cannot be widened to get a desired effect of performance.

BRIEF SUMMARY OF THE INVENTION

An object of this invention is to provide a volume controller for an electric musical instrument capable of readily controlling the sound volume of the electrical musical instrument in no need of the player's finger or hand operation.

Another object of this invention is to provide such a volume controller for an electric musical instrument as mentioned above and further capable of indicating the controlled condition of the sound volume.

Further object of this invention is to provide such a volume controller for an electric musical instrument as mentioned above and further capable of temporarily fixing the controlled condition of the sound volume at a constant state.

The above objects and other objects of this invention will be attained by a volume controller for an electric musical instrument of this invention, which comprises an audio-signal transmission circuit, swing means and control means. The audio-signal transmission circuit includes a variable circuit element and is inserted in the signal path of said electric musical instrument. The swing means is provided in the casing of the electric musical instrument to swing a pendulum about a support shaft in response to the inclination of the musical instrument. The control means is coupled to the swing means and the audio-signal transmission circuit for varying the value of the variable circuit element in accordance with the swing of the pendulum of the swing means so as to vary the sound volume of the electric musical instrument.

BRIEF DESCRIPTION OF THE DRAWINGS

The principle, construction and operation of this invention will be clearly understood from the following detailed description taken in conjunction with the accompanying drawings, in which.

DETAILED DESCRIPTION OF THE INVENTION

Figure 1:
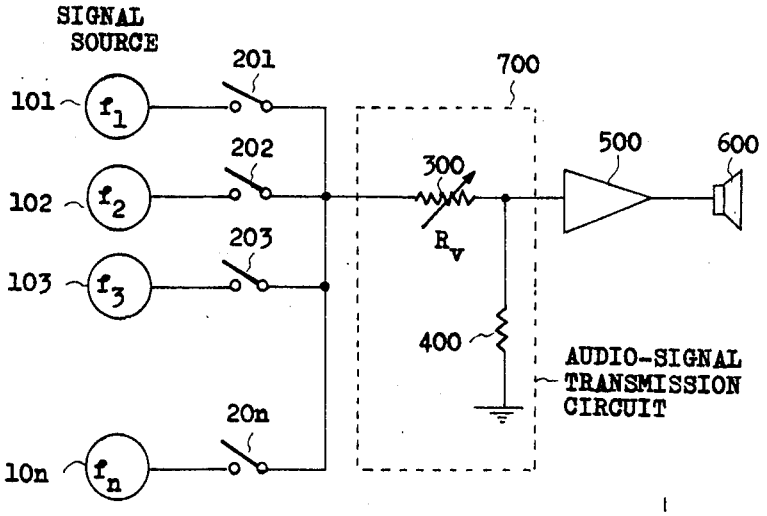
FIG. 1 shows a circuit diagram illustrating an embodiment of this invention.

With reference to FIG. 1, a circuit construction of an electronic musical instrument of portable type will be described. In FIG. 1, the outputs of signal sources 101, 102, . . . , 10*n* of frequencies $f_1, f_2, f_3, \ldots f_n$ representative of their respective musical scales are connected through switches 201, 202, . . . , 20*n*, which are opened and closed in accordance with the operation of keys or chord buttons, to a terminal of a variable resistor 300. The other terminal of the variable resistor 300 is connected to the input of an amplifier 500 and also through a fixed resistor 400 to the ground. In this circuit configuration, a change in the resistance $R_v$ of the variable resistance 300 causes a change in the volume of the musical sound radiated from a loud speaker 600 connected to the amplifier 500.

Figure 2:
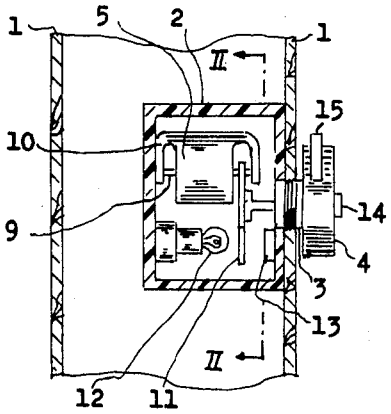
FIG. 2 is a part of the longitudinal section of an embodiment of this invention.
Figure 3:
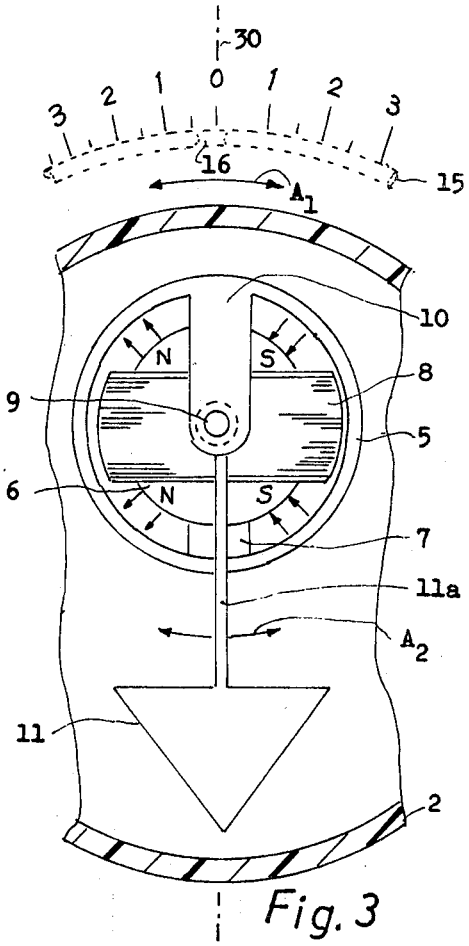
FIG. 3 is an enlarged section along a line II—II in FIG. 2.

FIGS. 2 and 3 show a preferred embodiment of the controller for varying the resistance $R_v$ of the valuable resistor 300. This embodiment comprises: a casing 1 of a musical instrument; a housing 2 rotatably attached by a shaft 3 to the casing 1; a nob 4 of the shaft 3 for rotating the housing 2 in the direction shown by an arrow $A_1$ with respect to the casing 1; a cylindrical yoke 5 fixed on the inside wall of the housing 2; a cylindrical parmanent magnet 6 mounted inside the yoke 5 through a non-magnetic spacer 7, a close-loop rectangular-frame movable coil 8 fitted to the parmanent magnet 6 and rotatably support by a shaft 9 between yoke protrusions 10 in a space between the magnet 6 and the yoke 5; a light shading plate 11 attached to the supporting shaft 9 of the coil 8 in such manner as to freely swing like a pendulum; a lamp 12 positioned in one side of a light shading plate 11; a photo-conductive element 13 placed on the other side of the light shading plate 11 to receive the light from the lamp 12; a stopper 14 extending through the knob 4 and the shaft 3 to the travelling course of the light-shading plate 11 to lock the plate 11; a level 15 mounted on the knob 4; and a bubble 16 in the level 15.

In this apparatus, the supporting shaft 9 is placed in parallel with the rotation axis of the housing 2, and the magnet 6 is energized to generate an indicated magnetic field in the space between the yoke 5 and the magnet 6. Since the coil 8 forms a closed-loop as mentioned above, a current flows in the coil 8 when rotated by a swing of the light shading plate 11, causing the damping action. The damping force can be changed by the adjustment of impedance of a variable resistor or the like incorporated to the coil loop, but usually it is desirable to fix the force at a critical damping condition.

Figure 4:
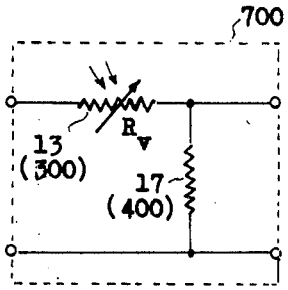
FIG. 4 shows an equivalent circuit illustrating an example of an audio-signal transmission circuit employed in this invention.

The photo-conductive element 13 is inserted between the input and output of the audio-signal transmission circuit 700 as shown in FIG. 4 to be used as the variable resistor 300, and the output terminal of the circuit 700 is grounded through another resistor 17 employed as the resistor 400.

Figure 6:
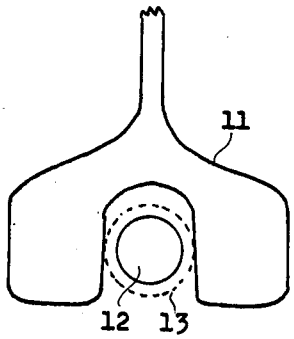
FIG. 6 is a plan view illustrating another example of a shading plate employed in this invention.
Figure 8:
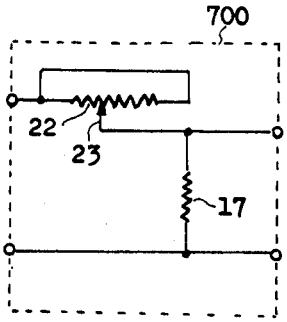
FIG. 8 is a circuit diagram illustrating another example of the audio-signal transmission circuit employed in this invention.
Figure 7:
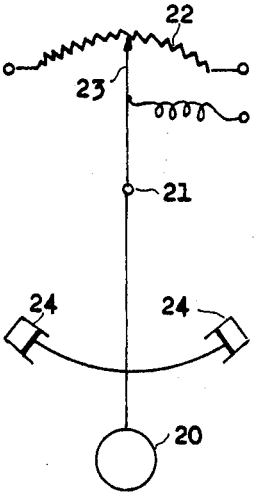
FIGS. 7, 9 and 10 illustrate other examples of a variable circuit element employed in this invention.

If the casing 1 is a little inclined, the light shading plate 11 moves in the direction indicated by an arrow $A_2$ under its own weight, since the gravity center of the plate 11 is kept on a vertical line 30 drawn through the shaft 9. Thus, the plate 11 restricts the amount of light radiated from the lamp 12 and reaching the photo-conductive element 13 and changes the resistance $R_v$ of the element 13. In other words, a change in amount of attenuation in the audio-signal transmission circuit 700 shown in FIG. 4 leads ultimately to the volume control of the musical instrument. In this mechanism, the resistance $R_v$ of the element 13 can be established to the maximum at a condition where, when a reference line 30 of the housing 2 and the center line 11*a* of the shading plate 11 coincide with each other, the photo-conductive element 13 is completely shaded by the light shading plate 11 as illustrated in FIG. 3. However, the element 13 may be so designed that the resistance $R_v$ can be established to the minimum value at that condition as apparently understood from the formation of the shading plate 11 shown in FIG. 6.

Figure 5:
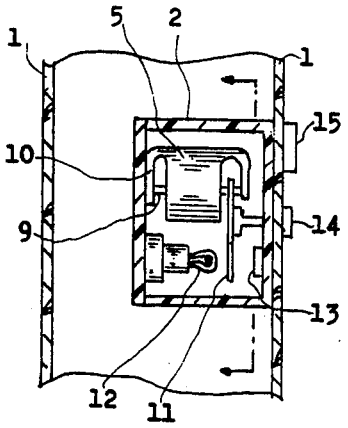
FIG. 5 is a part of the longitudinal section of another embodiment of this invention.

The housing 2 may be fixed to the inner wall of the casing 2 as shown in FIG. 5. In this case, the center line 11*a* of the shading plate 11 is initially established under the normal hold state of the casing 1 at a position where the center line 11*a* coincides with a reference line, which is a vertical line passing through the shaft 9.

As is obvious from the foregoing expression, the volume of a sound radiated from the speaker 600 depends upon the resistance $R_v$ of the photo-conductive element 13. Namely, the resistance $R_v$ depends upon the inclination angle of the light shading plate 11 and or the deflection angle of the center line of the housing 2 from the vertical line 30. Therefore, the indication of the deflection angle will inform the player the sound volume and helps the player much in the musical performances. For that purpose, the level 15 is conveniently provided at an appropriate position of the controller housing 2. Since the level 15 should be located at an easy sight position of the player, the level 15 is positioned on the upper part of the knob 4 in the example shown in FIGS. 2 and 3. In the example shown in FIG. 5, the level 15 is provided on the casing 1. The position of a bubble 16 in the level 15 will indicate the inclination angle of the housing 2 from the vertical line 30, or the sound volume. If a graduation is provided on the level 15 to indicate the position of the bubble 16, the volume control can be more accurately performed. Furthermore, if desired, the volume can be kept constant by pressing down the stopper 14 and prevent in a mechanical way the light shading plate 11 from the swinging motion, so that a change in the inclination angles of the casing 1 and the housing 2 may not cause any change in the relative positions among the light shading plate 11, the lamp 12 and the photo-conductive element 13. The mechanical stopper 14 may be substituted by a stopper magnetically attracting and holding the shading plate 11.

As is described above, according to this invention, the player can control the volume at the player's option by changing the inclination angle of the casing 1 or the housing 2, and the player can freely change the sound volume during the musical performance to enhance the acoustic effect, and the player can start playing music at an appropriate volume. If the lower end of the casing 1 is shaped like a convex arc, the inclining action or the volume control will be smoothly conducted in a case where a music player plays the music instrument on a playing stand.

As shown in FIGS. 7 to 10, the present invention can be embodied in various forms. In the mechanism shown in FIG. 7 where a weight 20 is rotatably mounted about a support shaft 21 and a sliding tap 23 of the rheostat 22 is moved in accordance with the movement of the weight 20, the resistance $R_v$ of the rheostat is controlled by a change in position of the sliding tap 23 in response to a change in the inclination angle of the musical instrument. The members indicated by numerical notation 24 are dampers. A suitable example of the electric circuit 700 for this mechanism is given in FIG. 8.

Figure 9:
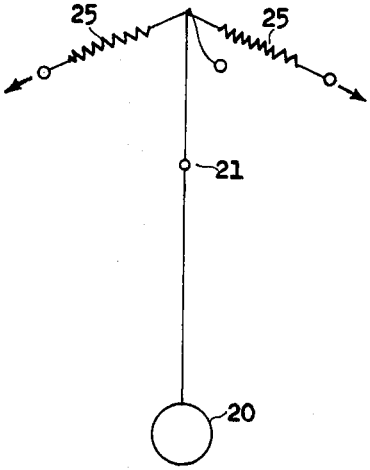
Figure 10:
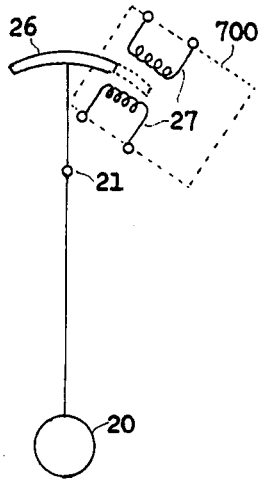

FIG. 9 shows an embodiment in which the resistance $R_v$ of the strain gauge 25 are varied in magnitude by a movement of a weight 20 about a shaft 21. FIG. 10 shows another embodiment of the present invention where the movement of a weight 20 controls the position of a core 26 of a transformer 27 to vary the coupling coefficient of the transformer 27 in the transmission circuit 700. Moreover, the iron core 26 and the transformer 27 in FIG. 10 can be respectively substituted by a parmanent magnet and a magnetism-sensitive transistor positioned in the magnetic field. Displacement of the magnet resulting from a movement of the weight 20 raises a change in conductivity of the above transistor incorporated in the audio-signal transmission circuit 700 to obtain the desired volume control. It is also possible to use a voltage variation produced at such elements as a Hall-Effect element, a photo-tube and a photo-diode for varying the impedance of transistor, etc., incorporated in the audio-signal transmission circuit 700 to obtain the desired volume control.

What I claim is:

1. A volume controller for an electric musical instrument of portable type comprising:

an audio-signal transmission circuit including a variable circuit element and inserted in the signal path of said electric musical instrument;

swing means including a pendulum in the casing of said electric musical instrument so as to be swung about a support shaft in response to the inclination of said musical instrument; and control means coupled to said swing means and said audio-signal transmission circuit for varying the value of said variable circuit element in accordance with the swing of said pendulum so as to vary the sound volume of the electric musical instrument.

2. A volume controller according to claim 1, in which said variable circuit element is a photo-conductive element receiving a light from a lamp, and in which said control means comprises a light shading plate connected to said pendulum for controlling the amount of light received by the photo-conductive element.

3. A volume controller according to claim 1, in which said variable circuit element is a rheostat with at sliding tap controlled by said pendulum.

4. A volume controller according to claim 1, in which said variable circuit element is a coupling transformer having a primary winding and a secondary winding, and in which said control means comprises a core provided for controlling the coupling coefficient of the transformer in response to the swing of the pendulum.

5. A volume controller for an electric musical instrument of portable type comprising:

an audio-signal transmission circuit including a variable circuit element and inserted in the signal path of said electric musical instrument;

swing means including a pendulum in the casing of said electric musical instrument so as to be swung about a support shaft in response to the inclination of said musical instrument;

control means coupled to said swing means and said audio-signal transmission circuit for varying the value of said variable circuit element in accordance with the swing of said pendulum so as to vary the sound volume of the electric musical instrument; and housing means rotatably attached to said casing of said electric musical instrument for seating therein said pendulum in said casing.

6. A volume controller according to claim 5, in which said swing means further comprises means for damping the swing action of said pendulum.

7. A volume controller according to claim 5, in which said variable circuit element is a photo-cnductive element receiving a light from a lamp, and in which said control means comprises a light shading plate connected to said pendulum for controlling the amount of light received by the photo-conductive element.

8. A volume controller according to claim 5, in which said variable circuit element is a rheostat with a sliding tap controlled by said pendulum.

9. A volume controller according to claim 5, in which said variable constant circuit element is a coupling transformer having a primary winding and a secondary winding, and in which said control means comprises a core provided for controlling the coupling coefficient of the transformer in response to the swing of the pendulum.

10. A volume controller for an electric musical instrument of portable type comprising:

an audio-signal transmission circuit including a variable circuit element and inserted in the signal path of said electric musical instrument;

swing means including a pendulum in the casing of said electric musical instrument so as to be swung about a support shaft in response to the inclination of said musical instrument;

control means coupled to said swing means and said audio-signal transmission circuit for varying the value of said variable circuit element in accordance with the swing of said pendulum so as to vary the sound volume of the electric musical instrument; and level means coupled to said casing of said electric musical instrument for indicating the inclination of said casing with respect to a reference line.

11. A volume controller according to claim 10, in which said level means is directly coupled to said casing.

12. A volume controller according to claim 10, further including housing means rotatably attached to said casing of said electric musical instrument for seating therein said pendulum in said casing, and in which said level means is coupled to said housing means.

13. A volume controller according to claim 10, in which said swing means further comprises means for damping the swing action of said pendulum.

14. A volume controller according to claim 10, in which said variable circuit element is a photo-conductive element receiving a light from a lamp, and in which said control means comprises a light shading plate connected to said pendulum for controlling the amount of light received by the photo-conductive element.

15. A volume controller for an electric musical instrument of portable type comprising:

an audio-signal transmission circuit including a variable circuit element and inserted in the signal path of said electric musical instrument;

swing means including a pendulum in the casing of said electric musical instrument so as to be swung about a support shaft in response to the inclination of said musical instrument;

control means coupled to said swing means and said audio-signal transmission circuit for varying the value of said variable circuit element in accordance with the swing of said pendulum so as to vary the sound volume of the electric musical instrument; and stop means coupled to said swing means for temporarily stopping the swing of said pendulum.

16. A volume controller according to claim 15, in which said swing means further comprises means for damping the swing action of said pendulum.

17. A volume controller according to claim 15, in which said variable circuit element is a photo-conductive element receiving a light from a lamp, and in which said control means comprises a light shading plate connected to said pendulum for controlling the amount of light received by the photo-conductive element.

* * * * *